US006428948B2

(12) United States Patent
Qiao et al.

(10) Patent No.: US 6,428,948 B2
(45) Date of Patent: Aug. 6, 2002

(54) IMAGED ELEMENT WITH IMPROVED WET ABRASION RESISTANCE

(75) Inventors: Tiecheng A. Qiao, Webster; Joseph S. Sedita, Albion; Mridula Nair, Penfield; Brian J. Kelley, Farmington; Yongcai Wang, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/805,335

(22) Filed: Mar. 13, 2001

Related U.S. Application Data

(62) Division of application No. 09/587,901, filed on Jun. 6, 2000.

(51) Int. Cl.[7] ..... G03C 1/85
(52) U.S. Cl. ..... 430/531
(58) Field of Search ..... 430/531

(56) References Cited

U.S. PATENT DOCUMENTS

| | | | | |
|---|---|---|---|---|
| 2,173,480 | A | 9/1939 | Jung | 352/56 |
| 2,259,009 | A | 10/1941 | Talbot | 430/14 |
| 2,331,746 | A | 10/1943 | Talbot | 352/238 |
| 2,706,686 | A | 4/1955 | Hilborn | 430/350 |
| 2,798,004 | A | 7/1957 | Weigel | 430/14 |
| 3,113,867 | A | 12/1963 | Van Norman et al. | 428/535 |
| 3,190,197 | A | 6/1965 | Pinder | 428/331 |
| 3,397,980 | A | 8/1968 | Stone | 430/8 |
| 3,415,670 | A | 12/1968 | McDonald | 427/271 |
| 3,443,946 | A | 5/1969 | Grabbäfer et al. | 430/537 |
| 3,502,501 | A | 3/1970 | Burczyk et al. | 430/537 |
| 3,697,277 | A | 10/1972 | King | 430/14 |
| 3,733,293 | A | 5/1973 | Gallagher et al. | 524/297 |
| 4,092,173 | A | 5/1978 | Novak et al. | 430/531 |
| 4,171,979 | A | 10/1979 | Novak et al. | 430/449 |
| 4,333,998 | A | 6/1982 | Leszyk | 430/12 |
| 4,426,431 | A | 1/1984 | Harasta et al. | 430/14 |
| 4,999,266 | A | 3/1991 | Platzer et al. | 430/14 |
| 5,179,147 | A | 1/1993 | Jones | 524/261 |
| 5,376,434 | A | 12/1994 | Ogawa et al. | 430/195 |
| 5,447,832 | A | 9/1995 | Wang et al. | 430/523 |
| 5,723,211 | A | 3/1998 | Romano et al. | 430/328 |
| 5,853,470 | A | 12/1998 | Martin et al. | 106/31.86 |
| 5,853,926 | A | 12/1998 | Bohan et al. | 430/14 |
| 5,856,051 | A | 1/1999 | Yau et al. | 430/14 |

OTHER PUBLICATIONS

Macmillan Publishing Co., Inc. (New York 1977), D.M. Burness and J. Pouradier, Sec. III Hardening of Gelatin and Emulsions, pp. 77–87.

*Primary Examiner*—Hoa Van Le
(74) *Attorney, Agent, or Firm*—Chris P. Konkol

(57) ABSTRACT

The present invention relates to photographic elements, including photographic prints, having a protective overcoat that resists fingerprints, common stains, and spills. More particularly, the present invention provides a processing-solution-permeable protective overcoat that is water resistant in the final processed product and which, at the same time, provides improved wet-abrasion resistance.

12 Claims, No Drawings

IMAGED ELEMENT WITH IMPROVED WET ABRASION RESISTANCE

CROSS REFERENCE TO RELATED APPLICATIONS

This is a Divisional of application Ser. No. 09/587,901 filed Jun. 6, 2000, now allowed.

FIELD OF THE INVENTION

The present invention relates to a method of post-development hardening of aqueous swellable binders underlying a relatively nonswellable protective overcoat of a photographic element. The invention also relates to a photographic element providing both water-resistance and improved wet-abrasion resistance.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, fingerprints can easily mark the imaged element, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described in U.S. Pat. Nos. 4,092,173, 4,171,979, 4,333,998 and 4,426,431. One drawback for the solvent coating method and the radiation cure method is the health and environmental concern of those chemicals to the coating operator. The other drawback is that these materials need to be coated after the processing step. Thus, the processing equipment needs to be modified as well as the personnel running the processing operation need to be trained. In addition, several lamination techniques are known and practiced in the trade.

U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing a mixture of high and low Tg latices as the water-resistant layer to preserve the antistat property of the $V_2O_5$ layer through photographic processing. This protective layer is not applicable to the image formation layers since it will detrimentally inhibit the photographic processing. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective. However, all these techniques need to be carried out after the image has been formed, which adds a large cost to the final imaged product.

Protective coatings that need to be applied to the image after it is formed, several of which were mentioned above, adds a significant cost to the final imaged product. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a serious concern, since polyethylene is a very soft material.

Similarly, commonly assigned U.S. Ser. No. 09/353,939 and U.S. Ser. No. 09/548,514, respectively, describe the use of a polystyrene-based material and a polyurethane-based material, with gelatin as the binder, in an overcoat for a photographic element, which overcoat can be fused into a water resistant overcoat after photographic processing is accomplished to generate an image. Finally, U.S. Ser. No. 09/548,514 describe the use of epoxy materials in the overcoat with gelatin as the binder, which similar to polyethylene, polystyrene and polyurethane can be fused into a water resistant overcoat after photographic processing is completed.

Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Ser. No. 09/448,213 disclose the use of a second polymer such as a gelatin or polyvinyl alcohol to reduce such defects and disadvantages.

A problem with these photographic elements, which have overcoats provided at the point of manufacture (and hence must be permeable to aqueous solutions during the processing step) is that the post-process photographic element with a water/stain resistant overcoat may exhibit unsatisfactory abrasion resistance in the wet state. In particular, if allowed to come into contact with aqueous solutions for a sufficient length of time such that the underlying hydrophilic layers can swell, the photographic element becomes prone to abrasion when wiped with a dry cloth or paper towel. Therefore, there is a need to improve the wet abrasion resistance of the imaged element bearing the aforementioned water resistant protective overcoat.

SUMMARY OF THE INVENTION

The present invention is directed to a method of processing a photographic element containing a processing-solution permeable overcoat overlying an aqueous swellable photographic layer comprising at least one hydrophilic binder, which method includes treating the photographic element, during or after development, with at least one hardening agent for the swellable binder, so that the swellability of the photographic layer relative to the overcoat is lowered. The photographic element, after processing, comprises a water resistant protective overcoat that exhibits very good wet abrasion resistance.

The present invention is also directed to a processed photographic element containing the final image, comprising a water-resistant protective overcoat overlying the imaged layers, wherein the photographic element has been hardened during or after development such that the Swell Ratio of the photographic element is less that 0.9, wherein the Swell Ratio is defined as the Equilibrium Swell of the photographic element after the hardening of step (d) divided by the Equilibrium Swell of an identical photographic element without the hardening in step (d). Preferably, the Swell Ratio is less than about 0.8, more preferably 0.1 to 0.8. Thus, the swellability of the photographic element is decreased by at least 10%, preferably at least 20% after development is completed compared to prior to development.

DETAILED DESCRIPTION OF THE INVENTION

The present invention provides an improved imaged photographic element (processed photographic element), such as a photographic print comprising a water-resistant overcoat, which imaged photographic element exhibits improved wet abrasion resistance. The present invention is also directed to a method of making the imaged photographic element by the use of a post-development hardener for treating the one or more image layers underlying the overcoat layer of an imaged photographic element. In accordance with the invention, the aqueous swellable binder in the image layers underlying the relatively nonswellable overcoat of the imaged element is hardened after exposure but during or after development of the image (not before development).

In one particular embodiment, a photographic element having at least one silver halide light-sensitive emulsion layer and a protective overcoat is treated after processing with a hardener for gelatin, and the overcoat layer comprises a pH switchable polymer, a crosslinker for the polymer, and a second polymer that is water soluble. This particular overcoat allows excellent permeability of the developer solution at pH greater than 7 during development of the silver halide light sensitive emulsion layer to provide an imaged photographic element.

In another embodiment of the invention, the overcoat may comprise a hydrophobic porous matrix containing a hydrophilic dispersed phase or hydrophobic polymeric particles in a soluble (or solubilizable) hydrophilc matrix. The polymer overcoat may be further coalesced into a continuous hydrophobic material by fusing (heat and/or pressure) if needed after processing to form a water-resistant or water impermeable protective overcoat with excellent gloss characteristics. Fusing, which depending on the overcoat, may be optional is preferably done at a temperature from 25 to 200° C.

Various hardening agents may be employed in the practice of this invention to obtain the necessary Swell Ratios. Many conventional hardeners are known, for example, to crosslink gelatin. Representative gelatin crosslinking agents useful in the present invention are illustrated, but not limited, by the following structures:

I. Aldehyde and Related Compounds:

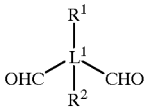

II. Pyridiniums:

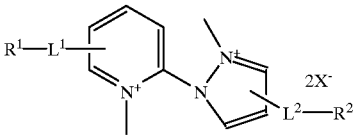

-continued

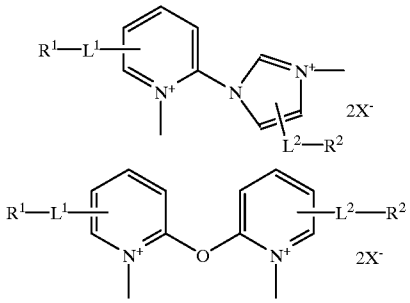

wherein X=$BF_4^-$, $CF_3SO_3^-$, PF6$^-$, Halide.

III. Olefins:

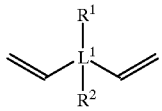

IV. Carbodiimides:

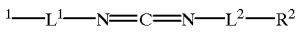

V. Epoxides:

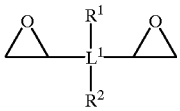

wherein linking groups $L^1$ and $L^2$ are each independently a single bond, a carbon atom, an oxygen atom, a sulfur atom, a carbonyl group

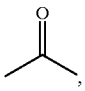

a carboxylic ester group

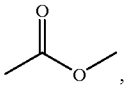

a carboxylic amide group

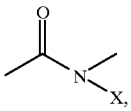

a sulfonyl group

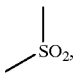

a sulfonamide group

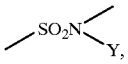

an ethyleneoxy group, a polyethyleneoxy group, or an amino group

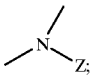

wherein substituents X, Y, and Z are each independently a hydrogen atom or an alkyl group of 1–4 carbon atoms; and wherein $R^1$ and $R^2$ are each independently a hydrogen atom, a substituted or unsubstituted, linear or branched, saturated or unsaturated alkyl group of 1 to 10 carbon atoms (such as methyl, ethyl, n-propyl, isopropyl, t-butyl, hexyl, decyl, benzyl, methoxymethyl, hydroxyethyl, iso-butyl, and n-butyl), a substituted or unsubstituted aryl group of 6 to 14 carbon atoms (such as phenyl, naphthyl, anthryl, tolyl, xylyl, 3-methoxyphenyl, 4-chlorophenyl, 4-carbomethoxyphenyl and 4-cyanophenyl), a substituted or unsubstituted cycloalkyl group of 5 to 14 carbon atoms such as cyclopentyl, cyclohexyl, and cyclooctyl), a substituted or unsubstituted, saturated or unsaturated heterocyclic group (such as pyridyl, primidyl, morpholino, and furanyl), a cyano group, or a solubilizing group such as a carboxylic acid group, a sulfonic acid group, a phosphonic acid group, a hydroxamic acid group, a sulfonamide group, and a hydroxy group (and their corresponding salts). Examples of suitable substituents for $R^1$ and $R^2$ include one or more sulfonate groups, sulfate groups, carboxy groups, hydroxy groups, phosphonic acid groups, hydroxamic acid groups, amine groups, amide groups, ester groups, sulfonamide groups, nitro groups, cyano groups, oxo groups, and halogen atoms. Preferably, at least one of $R^1$ and $R^2$ is or contains a solubilizing group that becomes negatively charged when ionized, such as an acidic group. Examples of these solubilizing groups include, but are not limited to, carboxylic acid, sulfonic acid, phosphonic acid, hydroxamic acid, sulfonamide, and hydroxy groups (and their corresponding salts). One or more of $R^1$ and $R^2$ also may be, or may contain, a polyethylenoxy group. $R^1$ and $R^2$ may be joined by sufficient numbers of carbon, nitrogen, and sulfur atoms to form, independently, a five- or six-membered ring. When L is linked to a ring structure, it could be single or multiple substitutions.

More specific representative examples of hardening agents are represented by the following structures:

I. Aldehyde and Related Compounds:

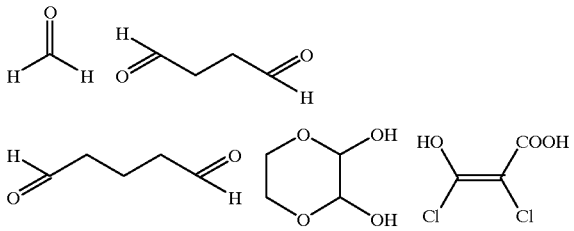

II. Pyridiniums:

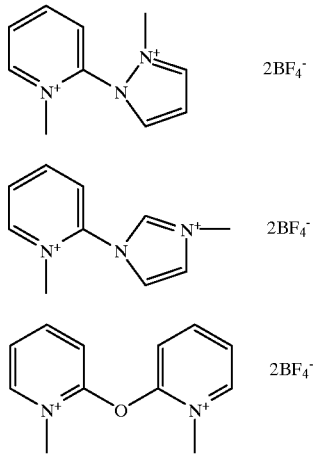

III. Olefins:

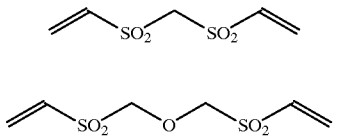

IV. Carbodiimides:

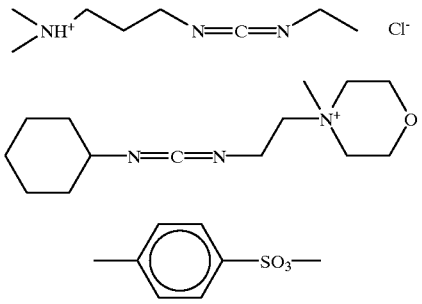

V. Epoxides:

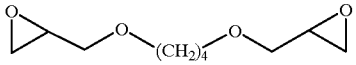

VI. Triazines:

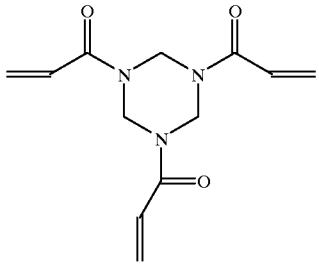

These compounds can be readily prepared using the published synthetic procedure or routine modifications that would be readily apparent to one skilled in the art of synthetic organic chemistry.

Other examples of hardening agents can be found in standard references such as The Theory of the Photographic Process, T. H. James, Macmillan Publishing Co., Inc. (New York 1977) or in *Research Disclosure*, September 1996, Number 389, Part IIB (hardeners). *Research Disclosure* is published by Kenneth Mason Publications, Ltd., Dudley House, 12 North St., Emsworth, Hampshire P010 7DQ, England. Organic hardening agents are preferred over inorganic hardeners.

The imaged photographic element contains at least one imaged layer containing image dye (derived from the reaction of the original silver-halide with dye-forming coupler in the emulsion) and comprises at least one binder or vehicle that can be hardened according to the present invention. Useful binders include naturally occurring substances such as proteins, protein derivatives, gelatin (e.g., alkali-treated gelatin such as cattle bone or hide gelatin, or acid treated gelatin such as pigskin gelatin), and gelatin derivatives (e.g., acetylated gelatin, phthalated gelatin, and the like). Also useful as vehicle extenders are hydrophilic water-permeable colloids. These include synthetic polymeric peptizers, carriers, and/or binders such as poly(vinyl alcohol), poly (vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

In the case of gelatin as the vehicle, gelatin crosslinking agents (as the hardener) are included in a processing solution in an amount of at least about 0.01 wt. % and preferably from about 0.1 to about 10 wt. %. More than one gelatin crosslinking agent can be used in the rinse solution if desired.

In one embodiment of the invention, the hardening agent may be included in a rinse solution following the developing solution. Alternatively, it is also possible to have the hardening agent in the developing solution, so long as the hardening is less rapid than the development or is completed after the development is substantially or essentially completed.

In still other embodiments of the invention, the hardening agent can be contained in a blocked form in the photographic layer, which blocked form is released during development or later, for example, by high alkalinity. Examples of blocking groups for hardeners can be found in the prior art. Alternatively, one or more hardening agents may be contained in a separate layer from the imaging layer, whereby the hardening agents are released and/or migrate to the photographic layer during or after development of the image.

In one preferred embodiment of the invention, in which the primary binder is gelatin, the hardening agent is applied to the imaged element in the form of a rinse solution. The pH of the rinse solution is generally not adjusted after the addition of gelatin crosslinking agent and it could be either acidic or alkaline depending on the choice of the crosslinking agent. However, certain buffer solution can be used, if desired, to control the pH of the rinse solution. Particularly useful buffers include, but are not limited to, carbonates, borates, tetraborates, phosphates, glycine salts, leucine salts, valine salts, proline salts, alanine salts, aminobutyric acid salts, lycine salts, guanine salts and hydroxybenzoates.

The support material used with this invention can comprise various polymeric films, papers, glass, and the like. The thickness of the support is not critical. Support thicknesses of2 to 15 mils (0.002 to 0.015 inches) can be used.

One type of coating composition that can be employed for forming a protective overcoat layer in accordance with the present invention comprises a continuous aqueous phase having therein a film forming binder, wherein the binder comprises hybrid urethane-vinyl copolymer having an acid number of greater than or equal to 5 and less than or equal to 30. Acid number is in general determined by titration and is defined as the number of milligrams of potassium hydroxide (KOH) required to neutralize 1 gram of the polymer. Another type of copolymer that can be used are polyester ionomers, disclosed in commonly assigned U.S. Ser. No. 09/588,960. Other types of overcoats that are designed to be process-permeable during development and water-resistant after development comprise a hydrophobic porous matrix or membrane as disclosed in U.S. Ser. No. 09/464,949, or comprise hydrophobic particles contained in a gelatin matrix, as disclosed in U.S. Ser. No. 09/547,374. Still other such overcoats comprise polymeric particles that employ fusing after development to close pores in the overcoat that exist during development, such as disclosed in U.S. Ser. No. 09/313,555, U.S. Ser. No. 09/353,939, and U.S. Ser. No. 09/548,514. Still other types of overcoats are contemplated. However such overcoats all have in common the fact that they are permeable to the water and developing solutions during development and become water resistant (but not completely water impermeable) in the final product. The use of the hardening agent to harden the underlying layers prevents any water that manages to soak through the overcoat from swelling. This can happen, even if the overcoat is water-resistant, if an aqueous solution such as punch or other such household commodity, is allowed to remain in contact with the imaged element for an extended period of time. For example, a print may be inadvertently laid on a wet spot on a table. It has been found that abrasion can potentially occur when the wet print is discovered and an attempt is made to dry the print, for example, by using a paper towel. In such circumstances, scratches can occur on the overcoat due to swelling of the underlying material and the resultant stress on the relatively non-swellable and non-healing overcoat. This phenomenon can be significantly reduced by means of the present invention. In contrast, if the imaged element did not have the water-resistant overcoat, such wet abrasion is not such a problem since the swollen layer could then heal. Merely drying the non-water-resistant print may suffice to return the print to its original state without damage.

The polymer overcoat should be clear, i.e., transparent, and preferably colorless. But it is contemplated that the polymer overcoat can have some color for the purposes of color correction, or for special effects, so long as it does not detrimentally affect the formation or viewing of the image through the overcoat. Thus, there can be incorporated into the polymer, dye that will impart color. In addition, additives can be incorporated into the polymer that will give the overcoat, desired properties. For example, a UV absorber can be incorporated into the polymer to make the overcoat UV absorptive, thus protecting the image from UV induced fading. Other additional compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

The surface characteristics of the protective overcoat in the photographic element are in large part dependent upon the physical characteristics of the polymers which form the more or less continuous phase and the presence or absence of solid, nonfusible particles. However, the surface characteristics of the overcoat also can be modified by the conditions under which the surface is fused. For example, in contact fusing the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol™ OT), and alkylcarboxylate salts such as sodium decanoate.

Matte particles wellknown in the art may also be used in an overcoat composition. Matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the overcoat may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143, 118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

An overcoat composition can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

The photographic elements in which the images to be protected can contain conductive layers. Conductive layers can be incorporated into multilayer photographic elements in any of various configurations depending upon the requirements of the specific photographic element. Preferably, the conductive layer is present as a subbing or tie layer underlying a magnetic recording layer on the side of the support opposite the imaging layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the imaging layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of the invention differ widely in structure and composition. For example, the photographic elements vary greatly with regard to the type of support, the number and composition of the image-forming layers, and the number and types of auxiliary layers that are included in the elements. In particular, photographic elements can be still films, motion picture films, x-ray films, graphic arts films, paper prints microfiche, or small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

The photographic elements claimed in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged photographic elements in accordance with this invention is to protect the element from reticulation and other physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

The photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

As an example of a preferred dye-forming coupler, an "NB coupler" is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The element can contain additional layers, such as filter layers, interlayers, overcoat layers, subbing layers, and the like. All of these can be coated on a support that can be transparent (for example, a film support) or reflective (for example, a paper support). Photographic elements claimed in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then usually with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development may be followed by bleach-fixing, to remove silver or silver halide, washing and drying. Newer types of film may eliminate some of the processing steps for the film, for example, if scanning is used to obtain the image information in electronic form prior to printing.

EXAMPLES

A urethane-acrylic "copolymer" (an interpenetrating network of two polymers) designated P1 was synthesized as described below. The polymer has an acid number of 11. The polyvinyl alcohols (PVA) used was (Airvol® 203), obtained from Air Products which was 87 to 89% hydrolyzed (by hydrolyzed is meant that the acetate groups in the monomeric units are converted to hydroxy groups). A crosslinker for the acid containing urethane-vinyl copolymer, CX 100 (a polyfunctional aziridine), was obtained from Neo Resins (a division of Avecia).

Synthesis of Polymer P1

Into a dry reactor was charged 96 grams of a diol (Millester® 9-55, MW2000 from Polyurethane Corporation of America), 87 grams of the methylene bis(4-cyclohexyl) isocyanate (Desmodur® W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point, 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 183 grams of methyl methacrylate, and 5 grams of acetoacetoxyethyl methacrylate, and then treated with 11 grams of triethylamine and 2.5 grams of initator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer was used as polymer P1 having an acid number of 11.

The protective polymer overcoat was coated over the UV layer of paper that was previously coated with light sensitive emulsions in a formulation described in Tables 1 and 2 below. The gelatin containing layers were hardened with bis(vinylsulfonyl methyl) ether at 1.95% of the total gelatin weight. The check coating included the overcoat as described in Table 1.

TABLE 1

| Layer | Laydown (g/m$^2$) |
|---|---|
| Overcoat | 0.557 Gelatin |
| | 0.002 SURF-1 |
| | 0.002 SURF-2 |
| | 0.204 Silica |
| | 0.17 Polydimethylsiloxane |
| UV | 0.111 UV-1 |
| | 0.019 UV-2 |
| | 0.033 SCV-1 |
| | 0.022 S-1 |
| | 0.022 S-2 |
| | 0.446 Gelatin |

TABLE 1-continued

| Layer | Laydown (g/m$^2$) |
|---|---|
| Cyan | 0.16 Red light sensitive AgX |
| | 0.365 C-1 |
| | 0.362 S-2 |
| | 0.028 S-3 |
| | 0.230 UV-1 |
| | 1.170 Gelatin |
| UV | 0.158 UV-1 |
| | 0.28 UV-2 |
| | 0.046 SCV-1 |
| | 0.032 S-1 |
| | 0.032 S-2 |
| | 0.630 Gelatin |
| Magenta | 0.067 Green-light sensitive AgX |
| | 0.280 C-2 |
| | 0.076 S-2 |
| | 0.033 S-4 |
| | 0.167 ST-1 |
| | 0.019 ST-2 |
| | 0.530 ST-3 |
| | 1.087 Gelatin |
| IL | 0.056 SCV-1 |
| | 0.163 S-2 |
| | 0.650 Gelatin |
| Yellow | 0.186 Blue-light sensitive AgX |
| | 0.42 C-3 |
| | 0.42 P-1 |
| | 0.186 S-2 |
| | 0.10 SCV-2 |
| | 1.133 Gelatin |

Photographic paper support
sublayer 1: resin coat (Titanox and optic brightener in polyethylene)
sublayer 2: paper
sublayer 3: resin coat (polyethylene)

TABLE 2

C-1 Butanamide 2-[2,4-bis(1,1-dimethylpropyl)phenoxy]-N-(3,5-dichloro-4-ethyl-2-hydroxyphenyl)

C-2

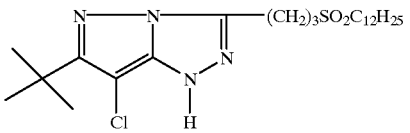

C-3

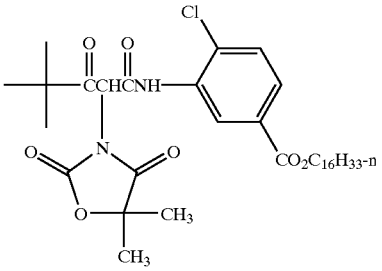

P-1

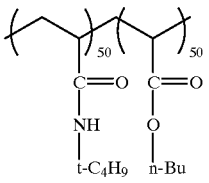

S-1 1,4-Cyclohexylenedimethylene bis(2-ethylhexaneoate)

TABLE 2-continued

S-2

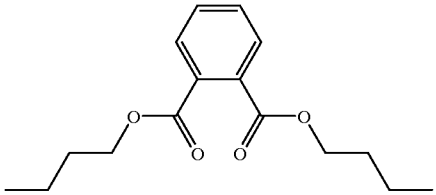

S-3 2-(2-Butoxyethoxy)ethyl acetate

S-4 Di-undecylphthalate

SCV-1

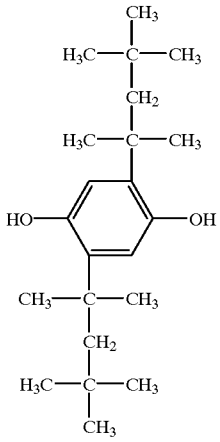

SCV-2 benzenesulfonic acid 2,5-dihydroxy-4-(1-methylheptadecyl)-mono-potassium salt

ST-1

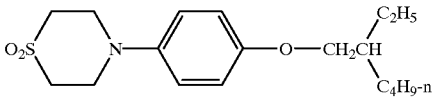

ST-2

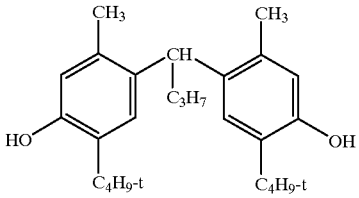

ST-3

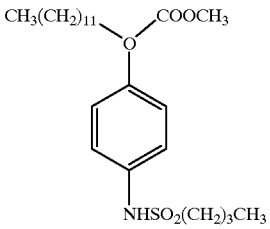

SURF-1

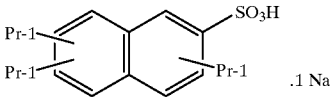

SURF-2 $C_8F_{17}SO_3N(C_2H_5)_4$

TABLE 2-continued

UV-1

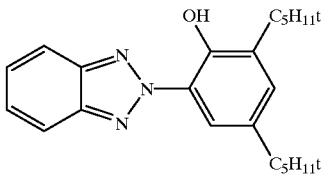

UV-2

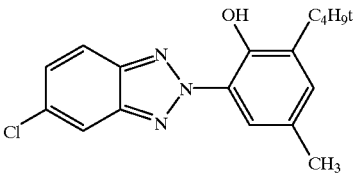

The urethane-vinyl copolymer P1 was coated over the UV layer of the sensitized paper support described above to obtain a nominal coverage of 2.15 g/m$^2$ for P1, to show the effect of in-process hardener treatment on wet scratch resistance. The coating had 35% PVA and one percent by weight CX100 crosslinker with respect to the polymer P1. For comparison, a check paper as described previously, without the polymer overcoat was used.

For the following examples, a color-paper developer solution was made following the formula given in Table 3 below. Similarly, a color-paper bleach/fix solution was made following the formula given in Table 4 below.

TABLE 3

| Developer Component | Concentration (g/L) |
|---|---|
| Lithium Sulfate (anhydrous) | 2.500 |
| Lithium polystyrene sulfonate (30% w/w solution) | 0.284 |
| KODAK EKTAPRINT ® 2 Stain Reducing Agent | 0.644 |
| Diethylhydroxylamine (85% w/w solution) | 2.357 |
| Potassium Sulfite (45%) | 0.786 |
| Potassium Chloride | 5.796 |
| Potassium Bromide | 0.034 |
| 4-amino-3-methyl-N-ethyl-N-(β-methanesulfonamidoethyl)aniline sesquisulfate monohydrate (CD3) | 3.883 |
| Potassium Carbonate (47%) | 52.63 |
| 1-Hydroxyethylidene-1,1-diphosphonic acid (60% w/w solution) | 1.147 |
| Water to make (pH adjusted to 10.12 with KOH or $H_2SO_4$) | 1 L |

TABLE 4

| Component | Tank |
|---|---|
| Water at 80–90° F. | 500 mL |
| KODAK Bleaching Agent, BL-1 | 85 mL |
| Total Iron | 7.5 g |
| Ammonium Thiosulfate, 58% | 105 mL |
| Sodium Sulfite | 10 g |
| pH at 25.0° C. | 6.20 |

Color paper was processed according to the sequence given in Table 5.

Using the above solutions, the color paper processing sequence used in the following Examples was as described in Table 5 below.

TABLE 5

| Step | Time (sec) |
|---|---|
| Developer | 45 |
| Bleach/fix | 45 |
| Wash | 90 |
| Rinse | Vary |

Table 6 lists the various gelatin crosslinking agents that were used to harden the photographic element with and without the protective polymer overcoat. These agents were added to the rinse solution, in the processing sequence described earlier.

TABLE 6

| Crosslinking Agent | Chemical Composition |
|---|---|
| CA1 | Formaldehyde |
| CA2 | 1-[3-dimethylamino)propyl]-3-ethyl carbodiimide |
| CA3 | mucochloric acid |
| CA4 | Bis(N-methyl-2-pyridylium tetrafluoroborate) |
| CA5 | 1-methyl-2-(2-methyl-1H-pyrazolium-1-yl)bis[tetrafluororate(1-)]Pyridinium, |
| CA6 | 1,4-Dioxane-2,3-diol |
| CA7 | Bis(vinylsulfonyl) methane |
| CA8 | 1,4-Butanediol diglycidyl ether |
| CA9 | 1,3,5-Triacryloylhexahydro-S-triazine |

Each of the crosslinking agents in Table 6 was added to the rinse solution to achieve a final concentration range from 0.1% to 10%. After RA-4 processing, the color paper with protective overcoat was air dried and the wet abrasion resistance tested by allowing a drop of coffee at room temperature, to sit on the surface for 1, 5, and 10 minutes. The liquid was then absorbed with a dry paper towel followed by further immediate wiping of the soaked area with a dry part of the towel. The resulting scratches if any were visually examined and ranked on a scale of 1 to 10 according to severity of the scratches with 1=a large number of visible scratches and 10=no visible scratches. The relative rating for wet scratch resistance after post-development hardening is given in Table 7 below.

The swell measurements were done on processed samples as follows. To measure the swell of each sample, the sample was allowed to swell in a pH 10 carbonate buffer solution for 5 minutes at room temperature, and the resulting total thickness of fully swelled sample was recorded as the equilibrium swell at that time. The term "Swell Ratio" as used herein refers to these measurements according to the following equation:

Swell Ratio=Equilibrium Swell of hardener-treated processed

Sample/Equilibrium Swell of hardener-untreated processed Sample

With respect to the claims, Swell Ratio is defined as follows:

Swell Ratio=Equilibrium Swell of hardener-treated processed photographic print/(divided by)

Equilibrium Swell of unprocessed photographic paper

The calculated Swell Ratio of the samples are listed in Table 7 below.

TABLE 7

| Hardener | Swell Ratio | Scuff Resistance Time (minutes) | | |
|---|---|---|---|---|
| | | 1 | 5 | 10 |
| None (check) | | 3 | 2 | 1 |
| CA1 | 0.17 | 10 | 10 | 10 |
| CA2 | 0.43 | 9 | 10 | 10 |
| CA3 | 0.28 | 10 | 8 | 7 |
| CA4 | 0.33 | 10 | 9 | 9 |
| CA5 | 0.28 | 10 | 8 | 7 |
| CA6 | 0.77 | 10 | 10 | 8 |
| CA7 | 0.83 | 10 | 4 | 3 |
| CA8 | 0.4 | 10 | 9 | 7 |
| CA9 | 0.56 | 10 | 9 | 7 |

These results show that a color paper with a protective water-resistant overcoat according to the present invention exhibits improved wet abrasion resistance after the during-process hardener treatment. The results show that the swell of the hardener-treated samples are decreased with respect to the untreated sample

What is claimed is:

1. An imaged photographic element having a water-resistant protective overcoat comprising:

(a) a support;

(b) at least one imaged layer comprising a dye image, which imaged layer is derived from processing a silver-halide light-sensitive emulsion layer, superposed on a side of said support; and (c) overlying the imaged layer, a water-resistant protective overcoat having a laydown of at least 0.54 $g/m^2$ (50 $mg/ft^2$) and having a thickness of less than 10 microns, which protective overcoat is relatively non-swellable relative to the underlying imaged layer;

wherein the Swell Ratio of the imaged photographic element is less than 0.9, wherein the Swell Ratio is defined as the Equilibrium Swell of the photographic element due to the introduction of hardening agent during or after development divided by the Equilibrium Swell of an identical photographic element identically processed without the introduction of hardening during or after development.

2. The photographic element of claim 1, wherein the Swell Ratio of the imaged photographic element is 0.1 to 0.9.

3. The photographic element of claim 1, wherein the protective overcoat is less than 5 microns thick.

4. The photographic element of claim 1, wherein the primary binder in the imaging layer is gelatin or a gelatin derivative.

5. The photographic element of claim 1 wherein the overcoat comprises a polymer having carboxylic acid groups.

6. The photographic element of claim 1 wherein the Swell Ratio of the photographic element is less than 0.8.

7. The photographic element of claim 1 wherein the overcoat comprises a polyurethane-containing component comprising urethane polymer in the amount of 20 to 100 percent by weight of the polyurethane-containing component, and an optional vinyl polymer in the amount of 0 to 80 percent by weight of the polyurethane-containing component.

8. The photographic element of claim 1, wherein the overcoat has residual amounts of polyvinyl alcohol having a weight average molecular weight and a degree of hydrolysis such that at least 30 percent by weight of the polyvinyl alcohol washes out during photographic processing.

9. The photographic element of claim 1 wherein the overcoat comprises a polymer that is a penetrating or semi-penetrating polymer network comprising at least two polymers.

10. The photographic element of claim 1 wherein the overcoat comprises a polymeric matrix derived from an inversion membrane.

11. The photographic element of claim 1 wherein the overcoat comprises polymeric particles that have been fused or coalesced in a post-development step.

12. The photographic element of claim 1 wherein the overcoat further comprises UV absorbers, surfactants, emulsifiers, coating aids, lubricants, matte particles, rheology modifiers, crosslinking agents, antifoggants, inorganic fillers, pigments, magnetic particles and/or biocides.

* * * * *